US005536140A

United States Patent [19]

Wagner et al.

[11] Patent Number: 5,536,140

[45] Date of Patent: Jul. 16, 1996

[54] FURNACE BLOWER HAVING SOUND ATTENUATION

[75] Inventors: Gregory P. Wagner, Atwater; Michael P. Conner, Uniontown, both of Ohio

[73] Assignee: Ametek, Inc., Kent, Ohio

[21] Appl. No.: 308,355

[22] Filed: Sep. 19, 1994

[51] Int. Cl.[6] ..... F04D 29/66

[52] U.S. Cl. ..... 415.00/119.0; 415/206; 415/211.1

[58] Field of Search ..... 415/119, 206, 415/211.1, 211.2, 204, 208.1

[56] References Cited

U.S. PATENT DOCUMENTS

| | | | |
|---|---|---|---|
| 963,957 | 7/1910 | Stocker | 415/211.1 |
| 985,279 | 2/1911 | Ohlson et al. | 415/206 |
| 2,322,357 | 6/1943 | Hagen | 415/211.2 |
| 3,034,702 | 5/1962 | Larsson et al. | 415/211.1 |

FOREIGN PATENT DOCUMENTS

| | | | |
|---|---|---|---|
| 58-101298 | 6/1983 | Japan | 415/204 |
| 4-350400 | 12/1992 | Japan | 415/204 |

*Primary Examiner*—Edward K. Look
*Assistant Examiner*—James A. Larson
*Attorney, Agent, or Firm*—Renner, Kenner, Greive, Bobak, Taylor & Weber

[57] ABSTRACT

A blower fan assembly is provided which includes a blower housing, an exhaust port having an air passage connected to the housing and an impeller assembly rotatably received within the housing. A sound attenuator is also provided to be received in the exhaust port. The attenuator includes at least one edge which extends into the housing to provide a gradual cutoff point. Air moving ahead of the rotating impeller vanes is partially redirected through the exhaust port by the attenuator. Remaining air is directed over and around the attenuator and is forced out of the housing at the cutoff point created where the exhaust port joins the housing. The redirection of air alleviates compression/decompression at the cutoffs thereby reducing the pulsing noise associated therewith.

8 Claims, 3 Drawing Sheets

FURNACE BLOWER HAVING SOUND ATTENUATION

TECHNICAL FIELD

The invention herein resides in the art of blower fans. More particularly, the invention relates to blower fans used in furnaces or the like. Specifically, the invention relates to noise attenuators used in conjunction with such blower fans.

BACKGROUND ART

Air moving devices or blowers have been used for many years in conjunction with both large scale and small scale air handling installations, such as forced air heating, ventilating, and air conditioning systems. Often, in smaller residential installations, compact, lightweight, centrifugal fans are used for this purpose. Typically, those fans include a rotating member which includes a plurality of vanes or blades disposed radially from the central hub and curving backward from the direction of rotation in the familiar curved sunburst configuration. This rotating member is journaled in a generally circular housing which includes an exhaust port. Blower fans, such as this, are notorious for the extraneous sounds produced while the fan is in operation. Many people find these sounds to be unpleasant and annoying, so various efforts have been made to alleviate such noises. Such efforts have included various methods of dampening vibration and insulating the fan with a sound absorbing material. However, air moving blowers by their very nature cannot be completely insulated. One major source of noise associated with these fans is the impeller blades passing a discrete obstruction. Sound is emitted from the blower at a frequency proportional to the rotational speed and the number of impeller blades passing the obstruction. With respect to centrifugal fans, such an obstruction is created at the point where the exhaust port joins the main housing. This point, where air is forced to exit the housing, is commonly referred to in the art as the "cutoff". As each blade passes the cutoff it operates to compress air between the blade and the cutoff. Simultaneously, a region of relatively lower pressure is created behind the blade. As such, a cycle of compression/decompression results, thereby generating a pulsing noise.

Because this noise does not emanate from a mechanical or frictional contact, but instead involves a pulsing of air, conventional anti-friction and vibration dampening devices do nothing to reduce this noise. Further, because the source of the noise is in direct communication with the air handling system and is carried therethrough.

Additionally, the nature of the cutoff results in an inefficient transition for the air coming off the impeller blades to the exhaust port. This inefficiency results in lost pressure capabilities at low flow rates.

Accordingly, it has been desired to reduce the amount of noise produced at its source as well as to increase transitional efficiency, so as to increase pressure capability at low flow rates.

DISCLOSURE OF INVENTION

In light of the foregoing, it is an aspect of the invention to provide a blower fan assembly having a sound attenuator incorporated therein.

Another aspect of the invention is the provision of a blower fan assembly having a sound attenuator which serves to reduce blade pass noise associated with the compression/decompression of air between the rotating blades and fixed obstructions.

Yet an additional aspect of the invention is the provision of a blower fan assembly having a sound attenuator which further serves to create a more efficient transition for air coming off the impeller to the exhaust port.

A still further aspect of the invention is the provision of a blower fan assembly having a sound attenuator which is reliable, durable, inexpensive to manufacture, and easy to implement with state of the art apparatus and techniques.

The foregoing and other aspects of the invention which will become apparent as the detailed description proceeds are achieved by the improvement in a blower fan assembly having an impeller member rotatably received within a blower housing and an exhaust port communicating with the blower housing so as to form a natural cutoff, comprising: attenuator means received within the exhaust port for redirecting a portion of air through the exhaust port before a remaining portion of air is directed therethrough, thereby alleviating compression and decompression at the cutoff so as to reduce pulsing noise.

Other aspects of the invention are attained by a sound attenuator for a blower fan housing or the like, comprising: a flat plate having a plurality of edges and adapted to be received in the housing, wherein one or more of the edges extend into the housing to provide a gradual cutoff point for air exiting the housing.

Still other aspects of the invention are attained by a blower fan assembly having a sound attenuator, comprising: a blower housing; an exhaust port connected with the blower housing and forming a cutoff within the blower housing, the exhaust port further including an air passage; impeller means rotatably received within the blower housing for directing air from the housing to the exhaust port, the impeller means including a plurality of vanes; and attenuator means received within the exhaust port for redirecting a portion of the air through the air passage before the remainder of the air is directed therethrough; whereby compression and decompression of air at the cutoff is partially alleviated thereby reducing compression and decompression noise.

DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
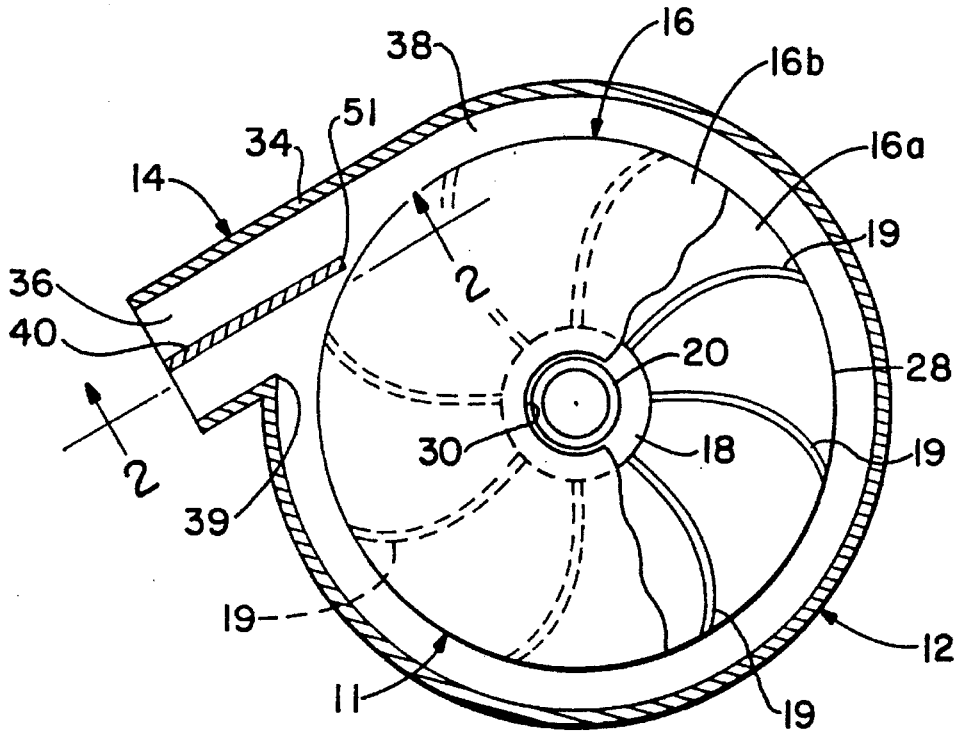
FIG. 1 is a partial sectional view of a blower fan assembly incorporating the novel sound attenuator of the invention.
Figure 2:
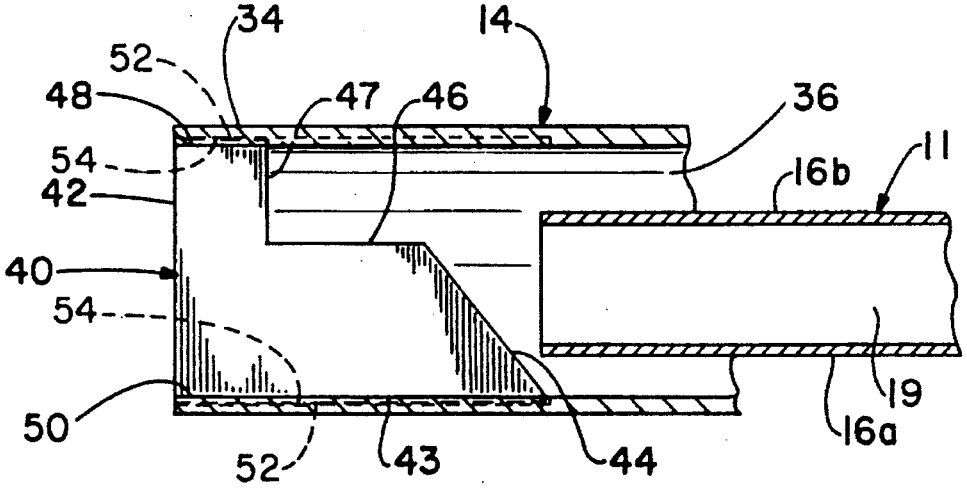
FIG. 2 is an enlarged cross-sectional view of the assembly of FIG. 1 taken along the line 2—2.
Figure 3:
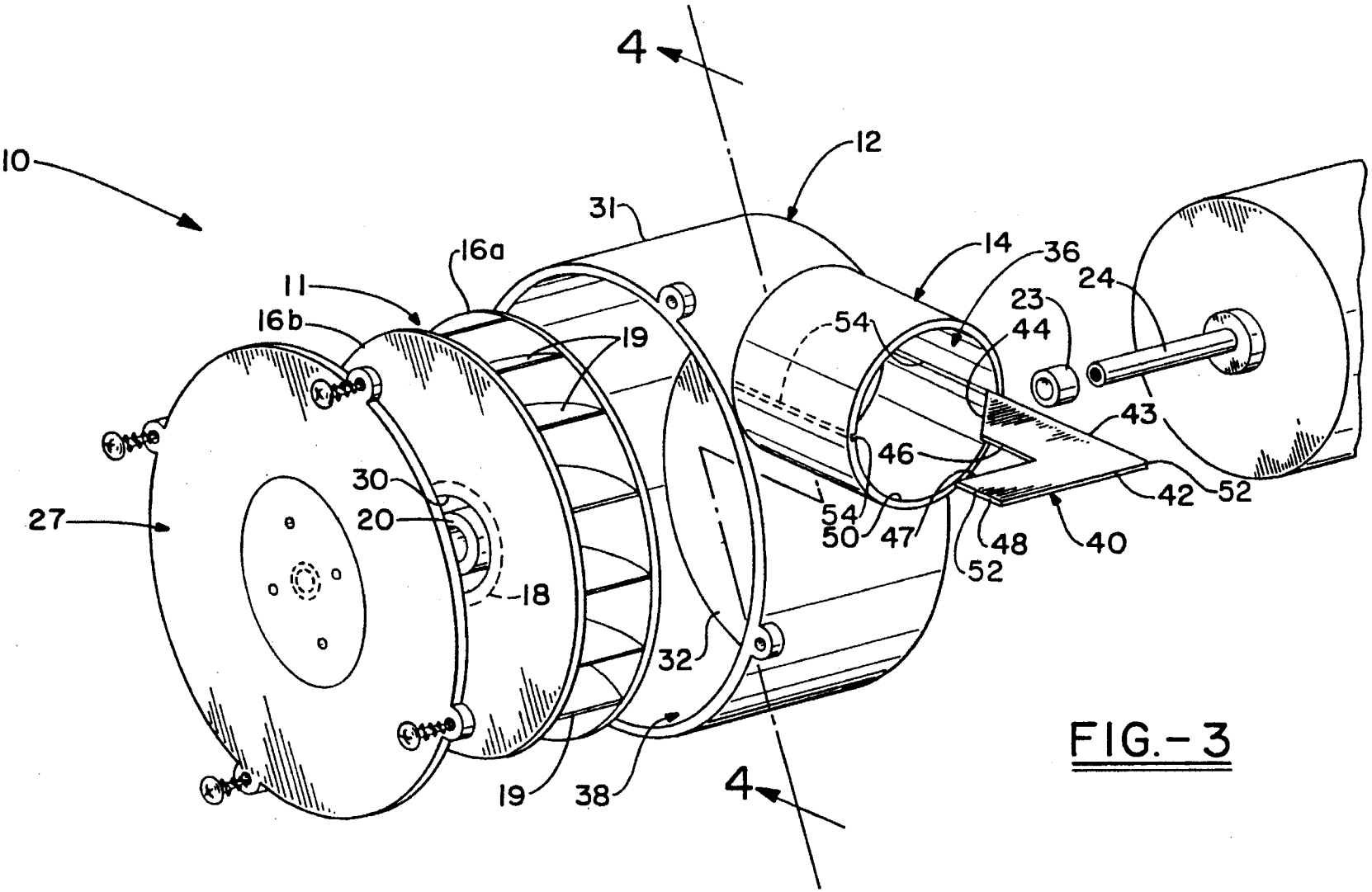
FIG. 3 is an exploded perspective view of a blower fan assembly incorporating the novel sound attenuator of the invention.

Referring now to the drawings, it can be seen that a blower fan assembly according to the invention is designated generally by the numeral 10. While it will be appreciated that the concept of the invention is applicable to a wide variety of air moving devices, the description herein will be with respect to a blower assembly of the nature shown. In such a device, representative of conventional centrifugal fans, a rotating impeller member 11 is journaled in a two-piece blower housing 12 which includes an exhaust port 14 and a motor shaft aperture 15.

As best shown in FIG. 1, the rotating impeller member 11 is of a generally annular disk shaped configuration 16 and includes a pair of annular disk shaped body members 16*a* and 16*b*. The main body member 16*a* includes a central hub 18 and a plurality of vanes 19 radiating therefrom. The central hub 18 extends axially from both sides of the member 16*a* in the form of a shaft 20 on one side. A shaft receiving recess 22 is provided on the other side, which is capable of either receiving a conventional locking collar 23 or directly receiving the motor shaft 24 by way of an interference fit. A plurality of vanes 19 radiate obliquely from central hub member 18 at equal intervals about the impeller radius and terminate at the outer perimeter 28 of the impeller 11. As can be seen in FIG. 1 the arrangement of vanes 19 radiating from hub 18 forms a familiar curved sunburst pattern, however it is contemplated that the vanes 19 could radiate straight from hub 18 without departing from the spirit of the invention. The main body member 16*b* is an annular disk shaped member having a central aperture 30. The body member 16*b* is mounted to body member 16*a* such that shaft portion 20 of hub 18 extends through aperture 30 and vanes 19 are interposed between body members 16*a* and 16*b*. As such, vanes 19 are substantially enclosed within the impeller member 11 so as to provide for more efficient air handling.

As can be seen from the drawings, the preferred blower housing 12 is comprised of a main housing portion 31 and a cover member 27. The main housing portion 31 includes a end wall 32 having a motor shaft aperture 15 contained therein. A generally circumferential side wall 34 extends orthogonally from the end wall 32 to form a generally cup-shaped or scroll shaped main housing portion 31. The cover member 27 is an annular disk shaped member having a circumference approximating that of the main housing portion 31 such that it may be mateably attached thereto in order to close the housing 12. Those skilled in the art will recognize that the cover 27 may be affixed to the main housing portion 31 by using any one of a number of conventional fastening techniques. As should now be apparent, impeller member 11 may be installed in housing 12 and linked to the motor shaft 24 through the motor shaft aperture 15. As such, the impeller member 11 may freely rotate within the housing 12, but is securely maintained therein.

An exhaust port 14 extends radially from one side of the housing 12. The port 14 includes a central air passage 36 which is in continuous and unobstructed communication with the interior 38 of the housing 12. As such, rotation of the impeller member 11 within the housing 12 forces air to exit the housing 12 via air passage 36.

As can best be seen in FIG. 1, at the innermost point where the exhaust port 14 joins the housing 12 a natural terminus or "cutoff" 39 is formed. It is this rather severe cutoff 39 which has previously produced the annoying pulsing sound associated with compression and decompression of air as each impeller vane 19 passes the natural cutoff 39. It should therefore be apparent why the frequency of such "blade-pass noise" (pulsing) is directly proportional to the number of vanes 19 passing the cutoff 39 times the rotating speed of the impeller member 11.

Accordingly, a sound attenuator 40 is fitted within the air passage 36 at the exhaust port 14. As a novel feature of the instant invention, the sound attenuator 40 is a generally flat polygonal insert which may be permanently affixed or removably received within the exhaust port 14. It is further contemplated that the attenuator 40 could be manufactured as an integral part of the exhaust port. The attenuator 40 is preferably of the approximate thickness of the side wall 34 of the housing 12, however the precise thickness of the attenuator 40 is not critical, provided that it is not so thick as to significantly reduce air flow through the passage 36.

Figure 4:
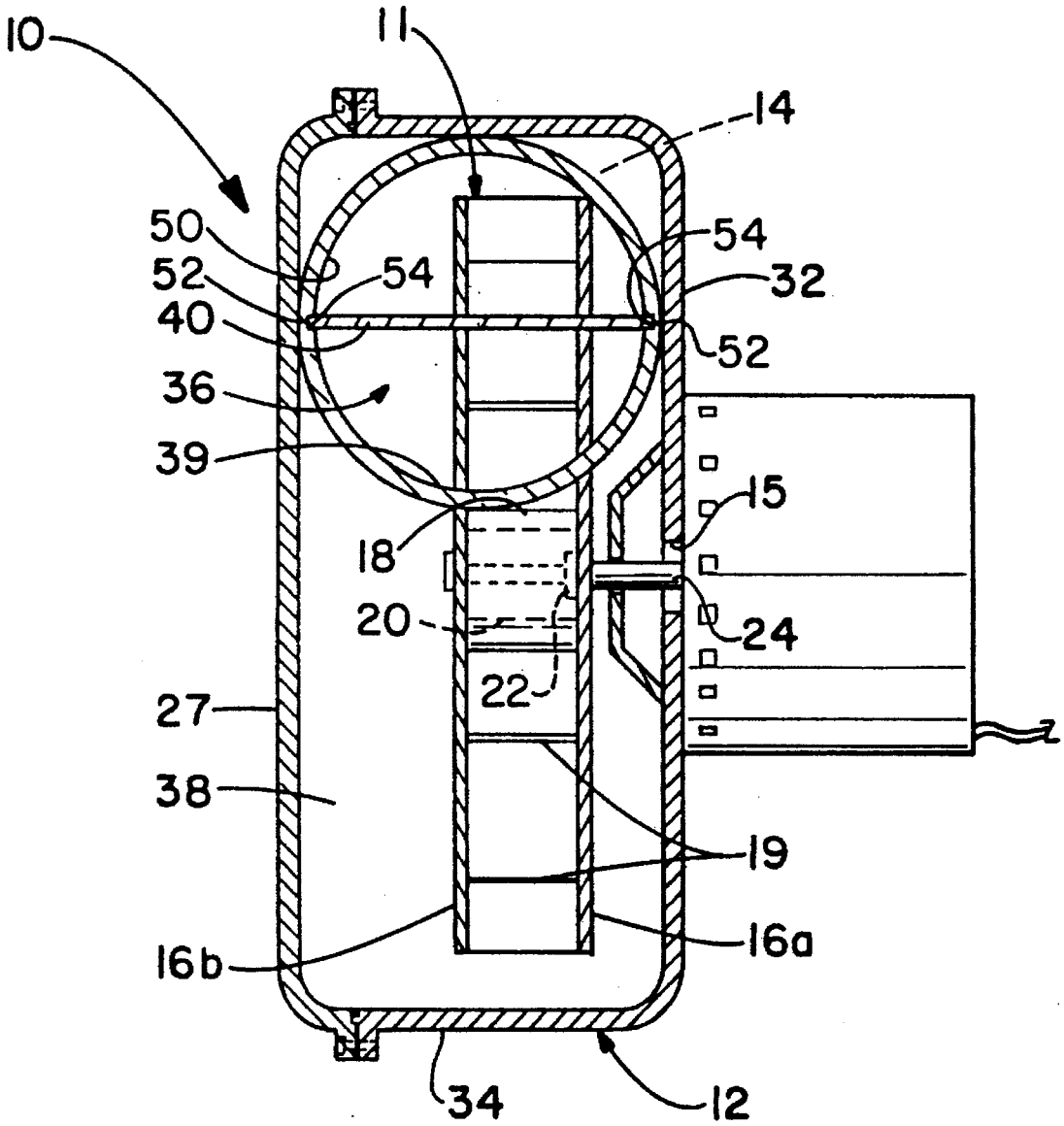
FIG. 4 is an elevational cross section of an assembled blower of FIG. 3 as may be taken along the line 4—4.

A representative embodiment of the attenuator 40 has a first edge 42, which in its length closely approximates the inside diameter of the air passage 36. A second edge 43 extends orthogonally from the first edge 42 and is approximately one-third longer than first edge 42. A third edge 44 extends obliquely from the second edge 42 and forms an acute angle relative thereto in the range of 30°–60°. A fourth edge 46 extends obliquely from the third edge 44, but is parallel to the second edge 43 and hence perpendicular to the first edge 42. A fifth edge 47 extends orthogonally from the fourth edge 46 and finally, a sixth edge 48 extends orthogonally from the fifth edge 47 joining with the first edge 42. As can be seen, the attenuator 40 is generally "L" shaped having one angled edge 44. The attenuator 40 is fitted into the mouth 50 of the exhaust port 14 such that it is perpendicular to the end wall 32 of the main housing portion 31 as shown in FIG. 4. As discussed previously, the attenuator 40 may be permanently affixed within the exhaust port 14 or removably mounted therein. If it is desired to retain removability, the attenuator 40 may, for example, be provided with tabs 52 which frictionally engage grooves or notches 54 in the exhaust port 14.

As shown, the first edge 42 of attenuator 40 is flush with the mouth 50 of the exhaust port 14, as such the angled third edge 44 extends beyond the air passages 36 and into the interior 38 of the housing 12. It should be apparent that the attenuator 40 does not extend into the interior 38 sufficiently to interfere with rotation of the impeller member 11. It should further be apparent that the attenuator 40 provides an additional, albeit less severe, cutoff 51 by way of angled third edge 44, fourth edge 46 and fifth edge 47.

It can be seen that placement of the attenuator cutoff 51 in a position that requires any given impeller vane 19, rotating counter-clockwise (with respect to FIG. 1), to pass the attenuator cutoff 51 immediately before passing the natural cutoff 39, allows a portion of the air, directed by the vanes 19, to be redirected through the air passage 36 before reaching the final cutoff 39. Thus, the amount of air subject to compression/decompression at the natural cutoff 39 is reduced, thereby reducing the disparity in relative pressure between compressed air immediately before the natural cutoff 39 and decompressed air immediately after the natural cutoff 39. This reduction in relative pressure serves to significantly reduce the pulsing sound produced during fan operation.

It will now be apparent that the unique shape of the attenuator 40 is important to achieving the desired attenuation of "blade pass noise". The angled third edge 44 provides an initial cutoff point which gradually increases to approximately half the height of air passage 36. As such, a portion of air is directed through the passage 36 while a portion is allowed to pass over and around the attenuator 40 to be directed through passage 36 at cutoff 39. Those skilled in the art will recognize that the attenuator 20 may accomplish its desired function while having any number of different shapes, without departing from the spirit of the invention. It is contemplated that experimentation with various attenuator 40 shapes will yield equally satisfactory results, provided that the profile of the attenuator 40 serves to create a less severe cutoff 51 than cutoff 39, thereby redirecting a portion of air through the passage 36 prior to final cutoff.

It has further been found that attenuator 40 also serves to provide a more efficient transition for air coming off the impeller member 11 to the exhaust port 14. This increase in transitional efficiency serves to increase the overall air volume directed through exhaust port 14, per unit of impeller speed, thereby resulting in improved overall fan efficiency. Those skilled in the art will recognize the benefits of improved fan efficiency particularly with respect to increased pressure capability of such fans 10 at low flow rates.

Thus, it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. In a blower fan assembly having an impeller member rotatably received within a blower housing and an exhaust port communicating with the blower housing, so as to form a natural cutoff, the improvement comprising:

attenuator means received within the exhaust port, said attenuator means comprising a flat plate for redirecting a portion of air through the exhaust port before a remaining portion of air is directed therethrough, thereby alleviating compression and decompression of air at the cutoff so as to reduce pulsing noise;

a plurality of notches in the exhaust port; and, a plurality of tabs on said attenuator means adapted to mateably engage said notches, thereby providing removable attachment of said attenuator means to the exhaust port.

2. The improvement in a blower fan assembly according to claim 1, wherein said flat plate has a plurality of edges forming a polygonal profile and one or more of said edges partially extends into the blower housing so as to provide an additional point of cutoff for air exiting the housing.

3. A sound attenuator for a blower fan housing, the blower fan housing having an exhaust port communicating therewith, the sound attenuator comprising:

a flat plate having a plurality of edges, said plate adapted to be received in the exhaust port;

a plurality of tab members on said plate; and a plurality of notches in the exhaust port, said tab members mateably engaging said notches;

wherein one or more of said edges extends into said housing to provide a gradual cutoff for air exiting the housing.

4. The sound attenuator according to claim 3, wherein said edges of said plate form a polygonal profile.

5. The sound attenuator according to claim 3, wherein said plate redirects a portion of air exiting the housing so as to alleviate compression and decompression pulsing.

6. A blower fan assembly having a sound attenuator, comprising:

a blower housing;

an exhaust port connected with said blower housing and forming a cutoff within said blower housing, said exhaust port further including an air passage;

impeller means rotatably received in said blower housing for directing air from said housing to said exhaust port, said impeller means including a plurality of vanes;

attenuator means received within said exhaust port, said attenuator means comprising a flat plate for redirecting a portion of said air through said air passage before the remainder of said air is directed therethrough;

said fiat plate having a plurality of tabs; and, said exhaust port having a plurality of notches for mateably engaging said tabs;

whereby compression and decompression of said air at said cutoff is partially alleviated, thereby reducing compression and decompression noise.

7. The blower fan assembly according to claim 6, wherein said attenuator means comprises a plurality of edges, one or more of said edges extending into said housing so as to provide an additional point of cutoff for air exiting the housing.

8. The blower fan assembly of claim 7, wherein said plate is permanently affixed within said exhaust port.

* * * * *